US008150061B2

(12) United States Patent
Ozawa

(10) Patent No.: US 8,150,061 B2
(45) Date of Patent: Apr. 3, 2012

(54) SOUND GENERATING METHOD, SOUND GENERATING APPARATUS, SOUND REPRODUCING METHOD, AND SOUND REPRODUCING APPARATUS

(75) Inventor: Kazuhiko Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 1956 days.

(21) Appl. No.: 11/209,724

(22) Filed: Aug. 24, 2005

(65) Prior Publication Data

US 2006/0044419 A1 Mar. 2, 2006

(30) Foreign Application Priority Data

Aug. 27, 2004 (JP) ..... 2004-248249

(51) Int. Cl.
*H04R 3/00* (2006.01)

(52) U.S. Cl. ..... 381/92; 381/91; 381/122; 381/26; 381/306; 348/346; 348/480; 348/482; 348/333.02

(58) Field of Classification Search ..... 381/306, 381/310, 56, 77, 80, 26, 92, 122, 333, 388, 381/61; 348/207.99, 333.06, 423.1, 14.12, 348/14.08–14.09; 345/418–419, 520, 90
See application file for complete search history.

(56) References Cited

U.S. PATENT DOCUMENTS

| | | | | |
|---|---|---|---|---|
| 6,298,942 | B1 * | 10/2001 | Schlatmann et al. | 181/144 |
| 7,206,418 | B2 * | 4/2007 | Yang et al. | 381/92 |
| 7,599,502 | B2 * | 10/2009 | Stromme | 381/92 |
| 7,602,924 | B2 * | 10/2009 | Kleen | 381/61 |
| 2001/0055059 | A1 * | 12/2001 | Satoda | 348/14.05 |
| 2002/0159603 | A1 | 10/2002 | Hirai et al. | |
| 2005/0111674 | A1 * | 5/2005 | Hsu | 381/92 |
| 2005/0146601 | A1 * | 7/2005 | Chu et al. | 348/14.09 |
| 2005/0152565 | A1 * | 7/2005 | Jouppi et al. | 381/309 |

FOREIGN PATENT DOCUMENTS

| | | |
|---|---|---|
| EP | 1 035 732 A1 | 9/2000 |
| JP | 01-178952 | 7/1989 |
| JP | 06-035489 | 2/1994 |
| JP | 06-062349 | 3/1994 |
| JP | 06-090492 | 3/1994 |
| JP | 06-327090 | 11/1994 |
| JP | 2000-010756 | 1/2000 |
| JP | 2000-298933 | 10/2000 |
| JP | 2000-299842 | 10/2000 |
| JP | 2002-191098 | 7/2002 |
| JP | 2003-264900 | 9/2003 |
| WO | WO-0018112 | 3/2000 |

OTHER PUBLICATIONS

Japanese Office Action dated Mar. 25, 2008 for the corresponding Japanese Application No. 2004-248249.
Extended European Search Report issue Aug. 24, 2010 for corresponding European Application No. 05 25 5208.

* cited by examiner

*Primary Examiner* — Devona Faulk
*Assistant Examiner* — Disler Paul
(74) *Attorney, Agent, or Firm* — Rader, Fishman & Grauer PLLC

(57) ABSTRACT

The present invention provides a sound generating method of generating sound signals related to a video signal, which comprises a step of generating independently each of the sound signals matched to a horizontal direction and a vertical direction of a video, and a step of allowing the horizontal and the vertical sound signals that have been generated to be reproduced independently with horizontal sound output means and vertical sound output means, respectively.

16 Claims, 13 Drawing Sheets

FIG. 11

(ROOM TEMPERATURE 25℃)

| | | DELAY T (μS) | | | |
|---|---|---|---|---|---|
| | | T1 | T2 | T3 | T4 |
| DIRECTIONAL ANGLE θ( °) | 90° | 88.2 | 58.8 | 29.4 | 0 |
| | 60° | 76.4 | 50.9 | 25.5 | 0 |
| | 30° | 44.1 | 29.4 | 14.7 | 0 |
| | 0° | 0 | 0 | 0 | 0 |
| | -30° | 0 | 14.7 | 29.4 | 44.1 |
| | -60° | 0 | 25.5 | 50.9 | 76.4 |
| | -90° | 0 | 29.4 | 58.8 | 88.2 |

SOUND GENERATING METHOD, SOUND GENERATING APPARATUS, SOUND REPRODUCING METHOD, AND SOUND REPRODUCING APPARATUS

BACKGROUND OF THE INVENTION

1. Field of the Invention

The present invention relates to a sound generating method, a sound generating apparatus, a sound reproducing method and a sound reproducing apparatus that are capable of generating and reproducing left-and-right and up-and-down sound signals relating to a video signal.

2. Description of Related Art

In recent years, a home TV (television) display apparatus increases a display size by reducing thickness and increasing flatness, which leads to an increase in whole apparatus size in not only a horizontal direction but also a vertical (height) direction.

A related art general TV is adapted to give voices or sounds through a reproducing apparatus such as speakers equipped at left and right sides of a display, irrespectively of an increase in display size, so that a stereophonic 2-channel reproduction has been often applied.

Further, in recent years, there is known a multi-channel surround reproduction technology that enables a reproduction to be as wide as 360 degrees with a DVD (Digital Versatile Disc) software etc. However, this technology also is adapted to reproduce a sound image located in the horizontal direction of a display using a plurality of speakers in most cases. Thus, there has not yet been provided an apparatus reproducing a sound field in the vertical direction to match the display.

[Patent Document 1] Published Japanese Patent Application (KOKAI) 2000-299842

[Patent Document 2] Published Japanese Patent Application (KOKAI) Hei 6-327090

By the way, the present applicant has previously proposed a video camera that performs a multichannel recording/reproduction of an audio input omni-directionally from a sound field space, together with a video (See the above Patent document 1). The technology of the above video camera enables an audio-video recording/reproduction to support the surround reproduction technology, in which case; however, a problem arises in which the above video camera technology has no ability to record and reproduce the sound field in the vertical direction of the display.

As described above, the display of the home TV display apparatus, etc. is increasing in size, which gives rise to a problem in which a technology of generating a horizontal sound field, such as a stereophonic sound field or an omni-directional surround sound field like the related art technology has difficulty in attaining a feeling of presence fitted to an image on the display.

SUMMARY OF THE INVENTION

The present invention has been undertaken in view of the above problems and is intended to provide, for adapting an increase in display size, a sound generating method and a sound generating apparatus that are capable of generating a sound field giving a richer feeling of presence to match a left-and-right direction and an up-and-down direction of a display.

Further, the present invention is also intended to provide, for adapting the increase in display size, a sound reproducing method and a sound reproducing apparatus that are capable of reproducing a sound field giving a richer feeling of presence to match the left-and-right and the up-and-down directions of the display.

To solve the above problems, the present invention provides a sound generating method of generating sound signals related to a video signal, and it is characterized by generating independently each of the sound signals matched to a horizontal direction and a vertical direction of a video, thereby permitting the horizontal and the vertical sound signals that have been generated to be reproduced independently with horizontal sound output means and vertical sound output means, respectively.

Further, a sound generating apparatus of the present invention is a sound generating apparatus for generating sound signals related to a video signal, and it comprises horizontal sound generating means for generating a sound signal matched to a horizontal direction of a video, vertical sound generating means for generating a sound signal matched to a vertical direction of the video, and directivity generating means for varying a directivity characteristic of each of the horizontal and the vertical sound generating means.

Meanwhile, a sound reproducing method of the present invention is a sound reproducing method of reproducing sound signals related to a video signal, and it is characterized by reproducing independently, with horizontal sound output means and vertical sound output means that are arranged to surround a vicinity of a display serving to display a video, a horizontal sound signal and a vertical sound signal that have been generated to match a horizontal direction and a vertical direction of the video, respectively.

Further, a sound reproducing apparatus of the present invention is a sound reproducing apparatus for reproducing sound signals related to a video signal, and it comprises a display screen serving to display a video, and horizontal sound output means and vertical sound output means that are arranged to surround a vicinity of the display and in which a horizontal sound signal and a vertical sound signal that have been generated to match a horizontal direction and a vertical direction of the video are reproduced independently with the horizontal and the vertical sound output means, respectively.

According to the present invention, each of the sound signals matched to the horizontal and vertical directions of the video is generated independently, and the generated horizontal and vertical sound signals are reproduced independently with the horizontal and vertical sound output means respectively, so that with the increase in video display size, one approach to further add an up-and-down (vertical) sound field to the related art technology of generating the left-and-right (horizontal) sound field ensures that an up-and-down motion of an object is given clearly and distinctly, and the object image may be matched to a sound source image direction through a spatial vector synthesis of the sounds from the up-and-down and the left-and-right directions, thereby enabling a more realistic stereoscopic sound field to be reproduced for providing a video full of the feeling of presence for a viewer. Further, the present invention is applicable not only to the video camera but also a purpose of games, etc., in which case, the same effect also may be obtained by generating the sound fitted to a video motion resulting from a synthesis with computer graphics.

A technology of generating the sound images not only in the horizontal direction but also in the vertical (height) direction with the increase in TV display size as described above offers merits as follows:

1. The up-and-down motion of the sound image is given clearly and distinctly. For instance, a sound originating from scenes of takeoff or landing of an airplane, or a moving action of pleasure instruments such as a slide or a roller coaster involving an up-and-down movement, or fireworks, etc. are given clearly and distinctly;

2. It is possible to overcome a problem that arises with the increase in display size, that is, a mismatch of an image with the sound image depending on vertical positions of left and right speakers; and 3. Lens view angle information of an image capturing system may be acquired to fit the sound image more accurately to a position of the sound given from the image, so that a sound field close to reality may be created, like a case where in a speaking scene of a person, the sound image is localized in an image position of "a mouth" of the speaking person.

BRIEF DESCRIPTION OF THE DRAWINGS

FIG. 11 is a table showing an example of microphone directional angle/delay conversion according to the present invention;

DESCRIPTION OF PREFERRED EMBODIMENTS

Figure 1A:
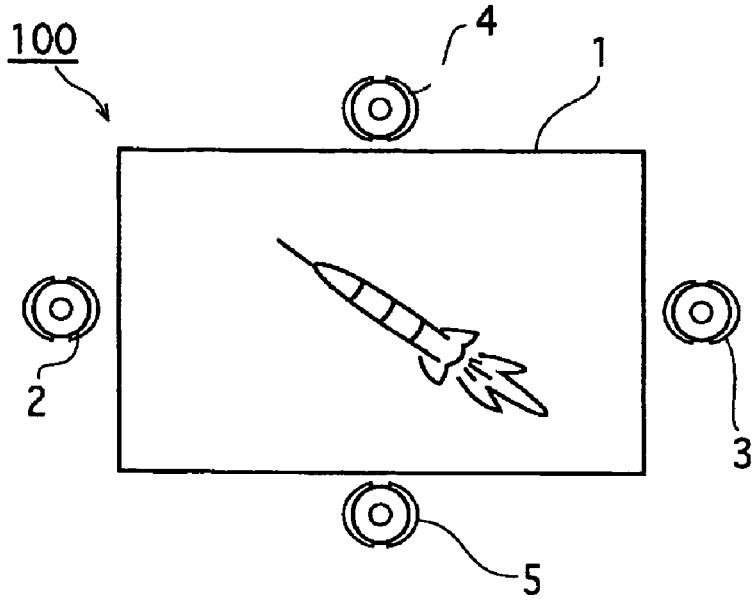
FIG. 1, consisting of FIG. 1A and FIG. 1B, is a schematic view showing a configuration of a sound reproducing apparatus according to one embodiment of the present invention.
Figure 1B:
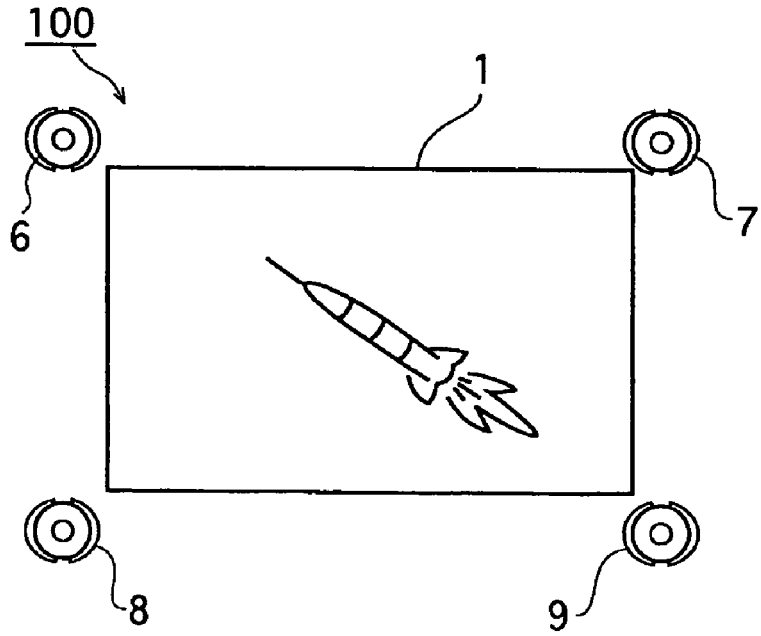

FIGS. 1A and 1B show a schematic configuration of a sound reproducing apparatus 100 according to one embodiment of the present invention. Referring to FIG. 1A, speakers 2, 3, 4 and 5 specified as sound output means are arranged to surround a display 1. The speakers 2 to 5 are placed respectively at approximately center portions of left, right, upper and lower edges of the display 1.

While the display 1 involves an application of a wide-screen thin-type flat display, such as a liquid crystal display, a plasma display and an organic electroluminescence display, it is to be understood that a CRT (Cathode-Ray Tube) and a small-sized display are also applicable as a matter of course.

The speaker 2 serves to reproduce a left (L)-channel sound field, and the speaker 3 serves to reproduce a right (R)-channel sound field. These speakers 2 and 3 are adapted to reproduce a left-and-right (horizontal) sound field. Further, the speaker 4 serves to reproduce an up (U)-channel sound field, and the speaker 5 serves to reproduce a down (D)-channel sound field. These speakers 4 and 5 are adapted to reproduce an up-and-down (vertical) sound field. It is noted that these speakers 2 to 5 are supposed to configure "horizontal sound output means" and "vertical sound output means" of the present invention.

The sound field reproduced through each of the speakers 2 to 5 is generated with a sound generating apparatus described later. The sound generating apparatus is operative to generate, with a plurality of microphones, the left-and-right and the up-and-down sound fields to be in correspondence with a video sound, so that each of the generated sound fields is reproduced independently through the speakers 2 to 5. For instance, the sound generating apparatus picks up each of the L-channel, the R-channel, the U-channel and the D-channel sound fields independently with the microphones for the respective channels to reproduce the picked-up sound fields with the corresponding channel speakers.

As described above, the sound reproducing apparatus 100 of the embodiment of the present invention provides a surround effect giving a feeling of presence to a viewer by reproducing, with the speakers 2 to 5, the left-and-right and the up-and-down sound fields in correspondence with the video displayed on the display 1, thereby enabling the reproduction of a stereoscopic sound field that has been given much more reality.

It is noted that, the speakers are not limited in arrangement to the one embodiment shown in FIG. 1A, and it is also allowable to arrange speakers 6 to 9 at four corner positions of the display 1 as shown in FIG. 1B, for instance. In this case, with the speaker 6 as a speaker for L and U channels, the speaker 7 as a speaker for R and U channels, the speaker 8 as a speaker for L and D channels, and the speaker 9 as a speaker for R and D channels, the speakers 6 to 9 are adapted respectively to effect the reproduction of the left-and-right and the up-and-down sound fields.

Figure 2:
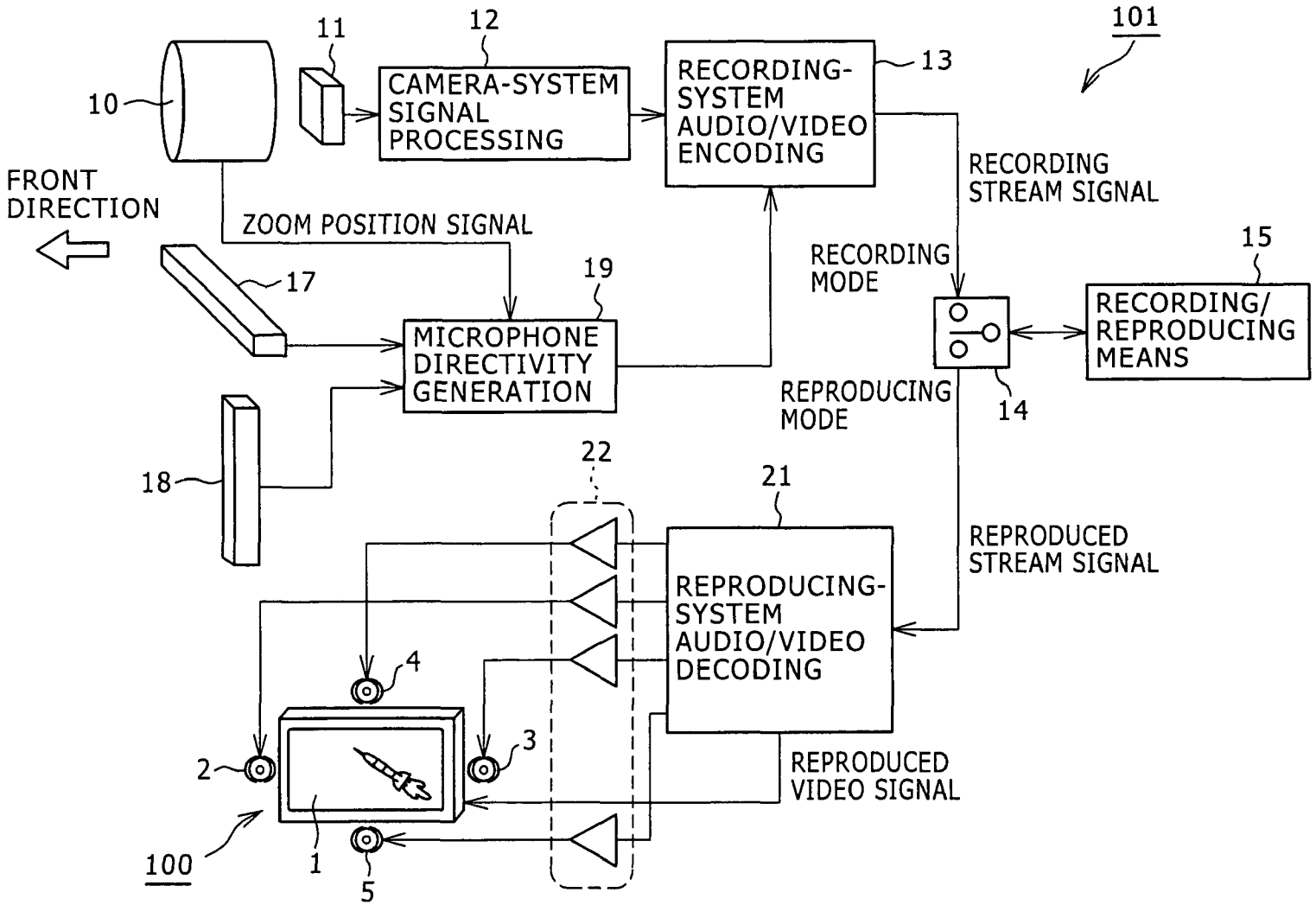
FIG. 2 is a functional block diagram showing a sound generating apparatus according to one embodiment of the present invention.

A sound generating apparatus 101 in one embodiment of the present invention is now described. FIG. 2 is a block diagram showing a configuration of the sound generating apparatus 101, which is applied to an audio-video recording apparatus, such as a home video camera, for instance.

Firstly, a video signal supplied from an image pickup element 11, such as a charge coupled device (CCD), etc., functioning as "image capturing means" of the present invention is inputted to a recording-system audio-video encoding processor 13 through a prescribed image conversion processing given with a camera-system signal processor 12. Meanwhile, audio signals supplied from microphones 17 and 18 are converted with a microphone directivity generating processor 19 into each directivity audio signal, which is then inputted to the recording-system audio-video encoding processor 13 for encoding into a prescribed recording stream signal together with the video signal. Then, the recording stream signal is recorded in a recording/reproducing means 15, such as video disc and videotape, through switching of a schematically shown switch 14 to a recording mode position.

Details of a zoom lens 10 and a zoom position signal will be described later.

Further, in a reproduction mode, the switch 14 is switched to a reproduction mode position to input a reproduced stream signal from the recording/reproducing means 15 to a reproducing-system audio-video decoding processor 21. Then, a decoded video signal is outputted to the display 1, while a decoded audio signal is outputted through a plurality of amplifiers 22 to the speakers 2 to 5 (or 6 to 9) arranged as shown in FIG. 1.

The microphones 17, 18 and the microphone directivity generating processor 19 are now described in detail.

One microphone 17 functions as a "horizontal sound generating means" of the present invention, and it is a microphone for generating directivity in a direction that is coincident with the horizontal direction of the image capturing element 11. The other microphone 18 functions as a "vertical sound generating means" of the present invention, and it is a microphone for generating directivity in a direction that is coincident with the vertical direction of the image capturing element 11. While the embodiment of the present invention is described in relation to an array microphone taken as one method to generate a directivity signal in each of the horizontal and the vertical directions, it is to be understood that other methods, such as the use of a microphone, etc., having a cardioid characteristic and super directivity are also available.

These microphones 17 and 18 may be mounted, for instance, on a casing panel at a back surface side of a display panel of the video camera in a cross shape or a T-like shape, etc. It is noted that the microphones 17 and 18 may be mounted in a X-like shape so as to give horizontal and the vertical directivities to the microphones respectively. In this case, the directivity signals adapted to the speakers 6 to 9 arranged as shown in FIG. 1B are supposed to be generated.

Figure 3A:
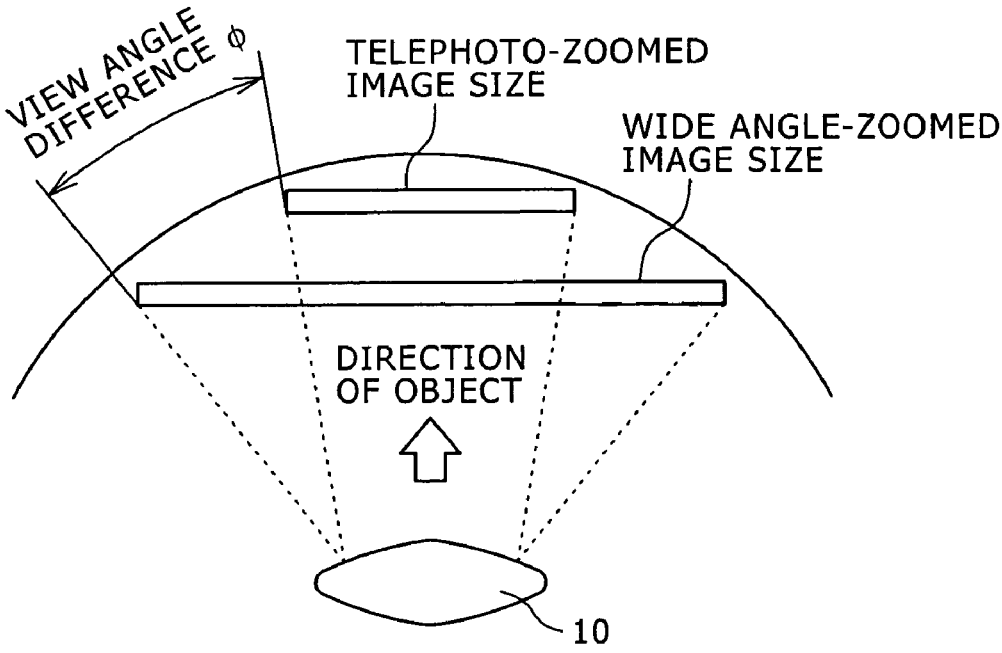
FIG. 3, consisting of FIG. 3A and FIG. 3B, is a view for explaining a view angle and a microphone directivity characteristic.
Figure 3B:
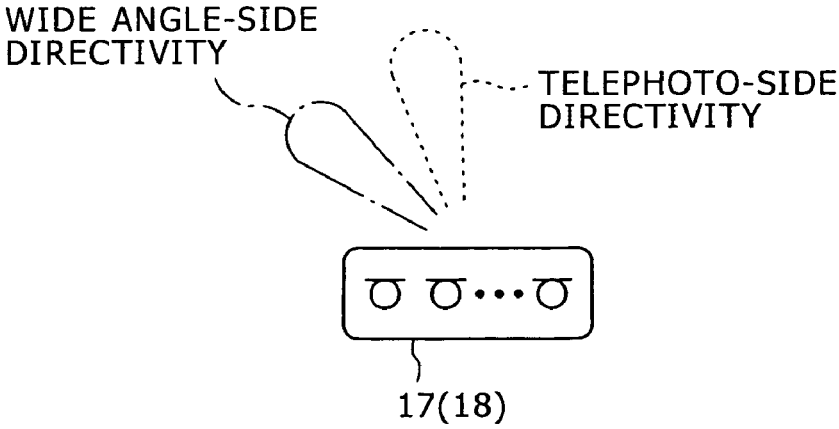

FIGS. 3A and 3B show a view angle/microphone directivity relation. In a general video camera, a zoom lens is adopted in an optical image capturing system. An image size is easily changed with a zooming of the zoom lens, so that a view angle difference $\phi$ is generated in image size between a wide angle side and a telephoto side, for instance.

Thus, in the embodiment of the present invention, as shown in FIG. 2, a zoom position signal is input from the zoom lens 10 to the microphone directivity generating processor 19 for changing the directivity of the microphone 17 (18) matched to the lens view angle in the given zoom position so as to create a difference in directivity between the wide angle side and the telephoto side. The microphone directivity generating processor 19 functions as "directivity generating means" of the present invention.

Figure 4:
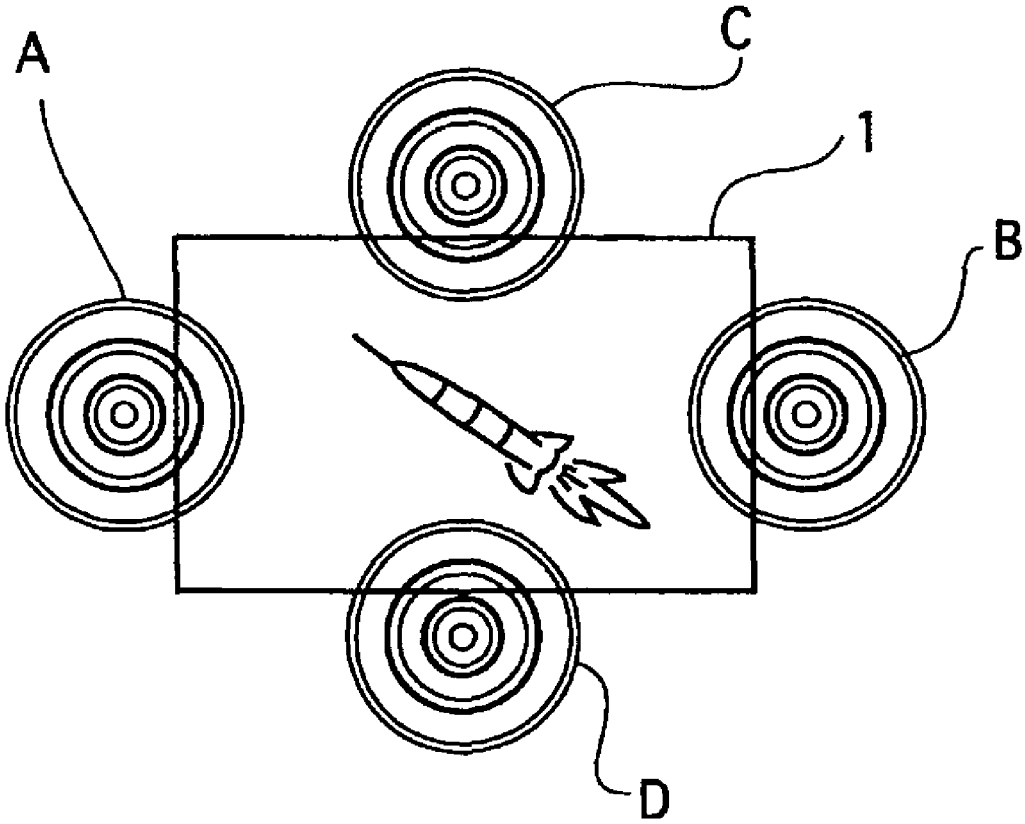
FIG. 4 is a view for explaining an example of microphone directivity generation.

FIG. 4 shows an example of generating the directivities of the microphones 17 and 18 toward directivity directions A, B, C and D that are equivalent to the positions of the speakers 2 to 5 shown in FIG. 1A. In this case, the directivities of the microphones 17 and 18 are supposed to be varied so as to provide a constant directivity direction for a captured image size at all times on the basis of given optical view angle information, even if the captured image size is changed in accordance with the zooming (See FIG. 3B).

It is noted that it is not always necessary to set the directivities of the microphones 17 and 18 to be varied to match the view angle given at the time of zooming as described the above. For instance, it does not matter if the directivities of the microphones 17 and 18 may be prefixed at all times in a wide angle-side position. In this case, a maximum feeling of presence is supposed to be obtainable at all times in the up-and-down and the left-and-right directions, irrespectively of the zooming.

Figure 5:
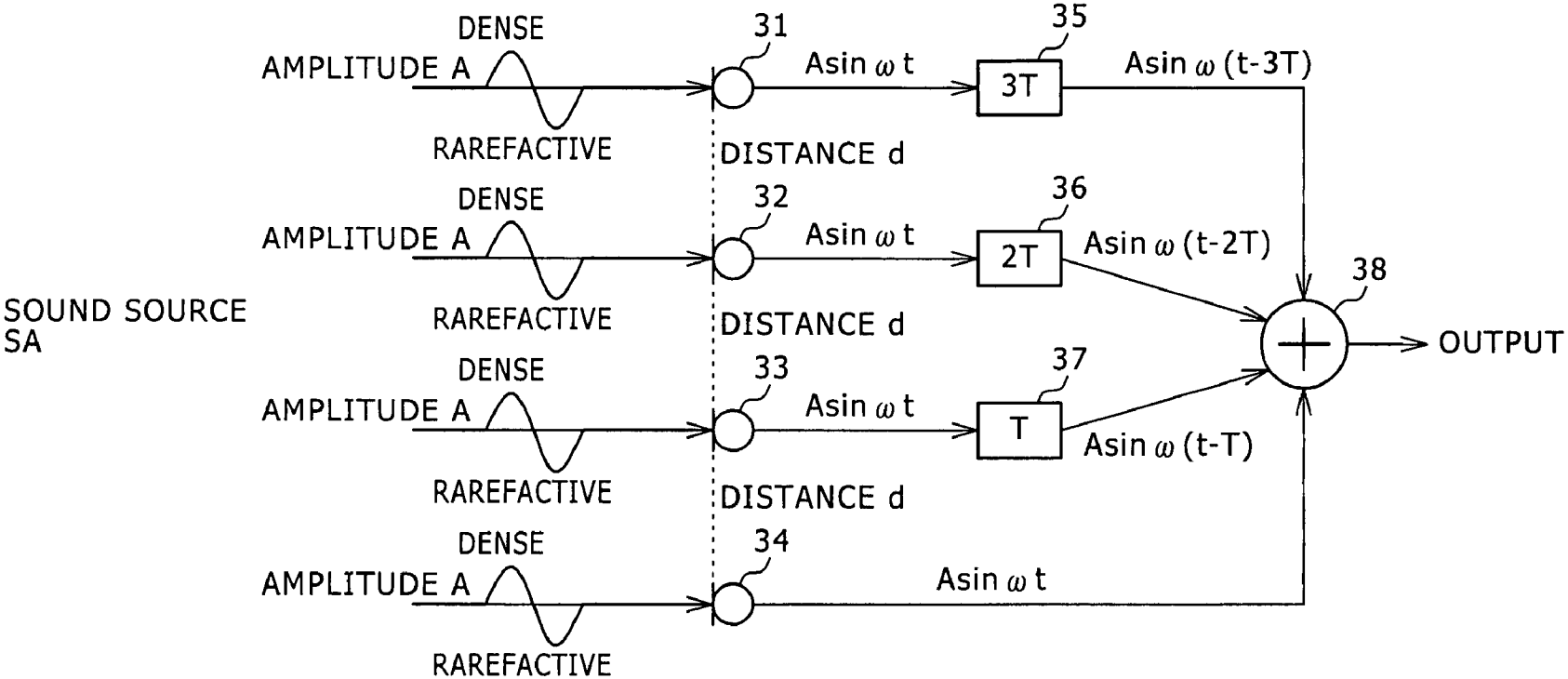
FIG. 5 is a view explaining a principle of an array microphone.
Figure 6:
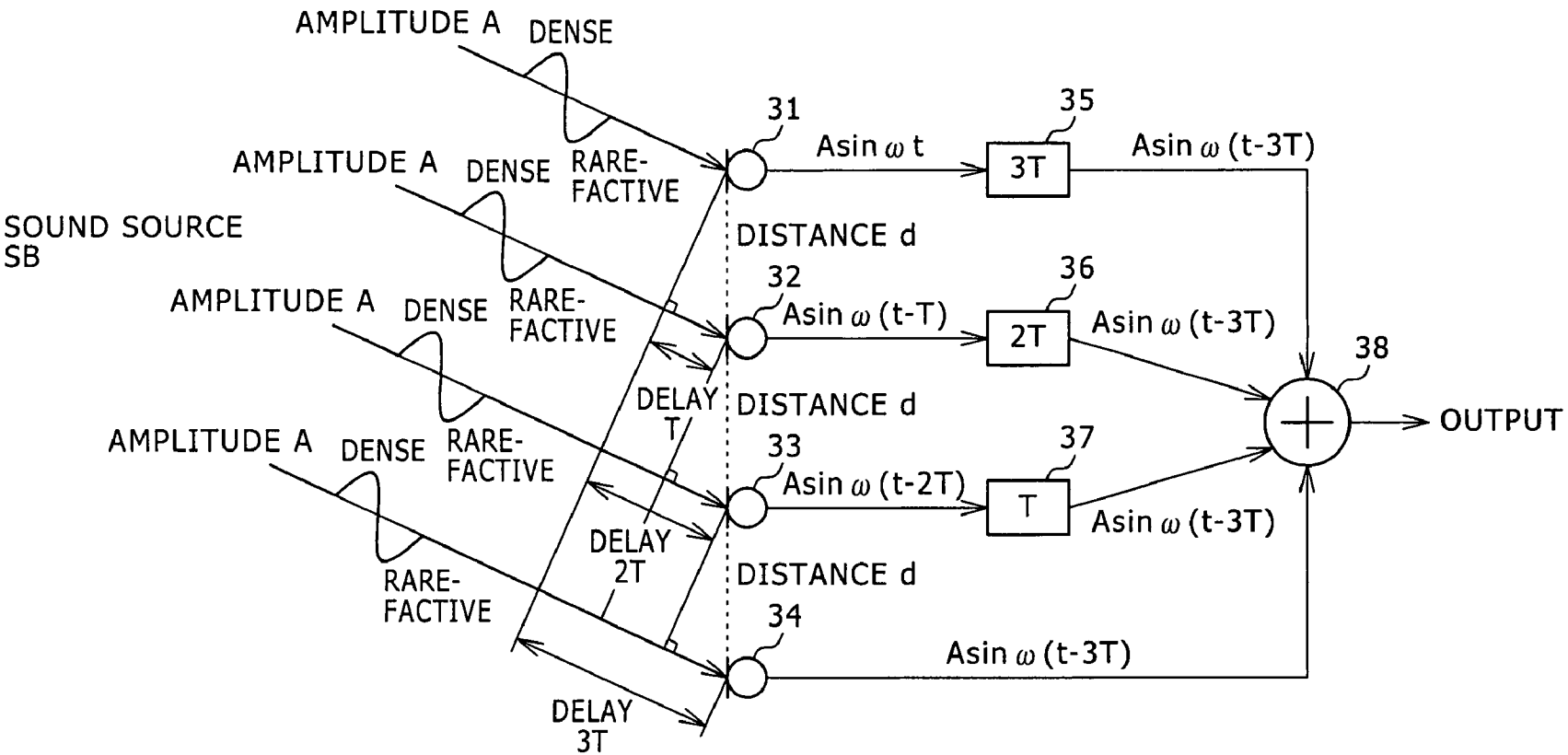
FIG. 6 is a view explaining the principle of the array microphone.

FIGS. 5 and 6 are views showing a principle of the array microphone contained in each of the microphones 17 and 18. The array microphone is now described in relation to one embodiment involving the use of four microphones 31, 32, 33 and 34.

Each of the microphones 31 to 34 is linearly arranged at a distance d. Then, outputs from the microphones 31, 32 and 33 are inputted to an adder 38 through delay units 35, 36 and 37, respectively. The adder 38 serves to add and output all the outputs from the delay units 35 to 37 and the output from the microphone 34 together. The delay unit 35 gives a delay 3T to the microphone output, the delay unit 36 gives a delay 2T to the microphone output, and the delay unit 37 gives a delay T to the microphone output.

Now assuming that inputs of sine waves each having an amplitude A are given from a sound source SA placed at a position being sufficiently remote from the distance d and also being approximately equally away from each of the microphones 31 to 34, the respective microphone outputs all result in A sin ωt. Further, the above outputs are given the respective delays in the delay units 35 to 37 and are then added in the adder 38. Thus, in the adder 38, the respective inputs, having been given delay differences T, are added as a result.

By the way, a resultant wave obtained in a case where two sine waves each having the delay difference T were added is shown in a following expression (1), where the amplitude A is specified as 1, for the sake of simplification.

$$\sin \omega t + \sin \omega(t-T) = 2\cos(\pi f T)\cdot\sin(\omega t - \pi f T) \quad (1)$$

Figure 7:
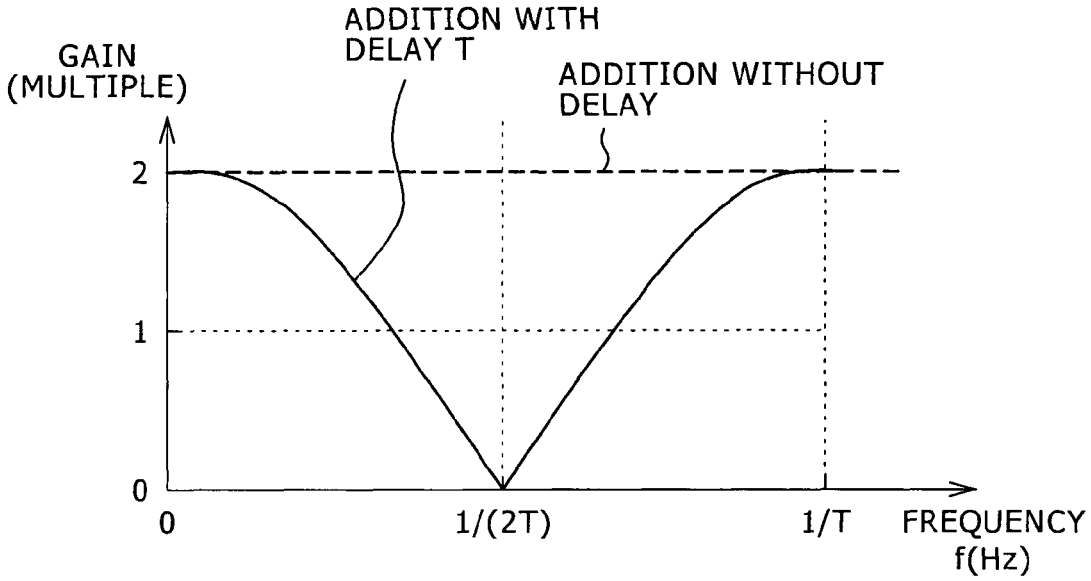
FIG. 7 is a graph for explaining an amplitude-to-frequency xrelation in a resultant wave of synthesizing two sine waves each having a delay difference T.

FIG. 7 shows, with a solid line, an example of a frequency characteristic obtained by normalizing a frequency f scaled at a horizontal axis with the delay difference T, provided that an absolute value of an amplitude term 2 cos(πfT) in the above expression (1) is scaled at a vertical axis.

As shown in FIG. 7, when the frequency is at 1/(2T), the amplitude reaches zero, being a minimum gain value, while when the frequency is at zero and 1/T, the amplitude reaches 2, specified as a maximum gain value, and a repetition of this frequency-to-amplitude relation follows. For instance, if there is given T=50 [μS (micro seconds)], this value is supposed to be equivalent to a distance difference of about 17 mm in terms of a sound velocity, in which case, a rise of the frequency from zero results in a decrease in amplitude, so that the amplitude reaches zero at the frequency of 10 kHz, while the frequency of 20 kHz causes the amplitude to reach a maximum value again. That is, even if an addition of the signals each having the amplitude A takes place in most of an audio band, the amplitude is supposed to decrease without being increased twice as much as A. It is noted that while in the above expression (1) two signals are added, it is to be understood that the more the number of signals to be added further increases, the more a rate of decrease in amplitude becomes distinctive.

Meanwhile, a case shown in FIG. 6 is a case where the sine waves each having the amplitude A are input at a prescribed angle from a sound source SB. In this case, A sin ωt is outputted from the microphone 31, and it is then given the delay 3T by the delay unit 35. Further, a sound wave reaches the microphone 32 later than the microphone 31 by a time corresponding to the delay T, so that A sin ω(t−T) is outputted from the microphone 32, and it is then given the delay 2T by the delay unit 36. Likewise, the sound wave reaches the microphone 33 later than the microphone 31 by a time corresponding to the delay 2T, so that A sin ω(t−2T) is outputted from the microphone 33, and it is then given the delay T by the delay unit 36. Further, the sound wave reaches the microphone 34 later than the microphone 31 by a time corresponding to the delay 3T, so that A sin ω(t−3T) is outputted from the microphone 34. Thus, the inputs to the adder 38 all result in signals having the same phase as A sin ω(t−3T)

By the way, the amplitude obtained in the case where the two sine waves were added at the same phase results in a two-fold amplitude in the whole frequency band, as shown by a broken line in FIG. 7. Thus, in the array microphone shown in FIG. 6, since in the adder 38 the signals are all added in a same phase state, the amplitude increases four times as much as A.

As described above, the array microphones shown in FIGS. 5 and 6 may give directional selectivity to the sound waves being sent from a sound source SB direction, which allows the directivity characteristic to be given to an arbitrary directional angle by setting the delay T to be variable. It is noted that the number of microphones or a microphone arrangement method respectively applied to the above described array microphones is illustrative and not restrictive, and it is to be understood that changes may be made without departing from the above principle.

By the way, in the array microphones 17 and 18, it is necessary to set, in the microphone directivity generation processing unit 19, delays that are the most suitable to the delay units shown in FIGS. 5 and 6 in order to generate the directivities in the directivity directions A, B, C and D shown in FIG. 4 and also change the directivities to the directivity direction corresponding to the view angle depending on the zooming as described above. One embodiment of the setting is described in the following.

Figure 8:
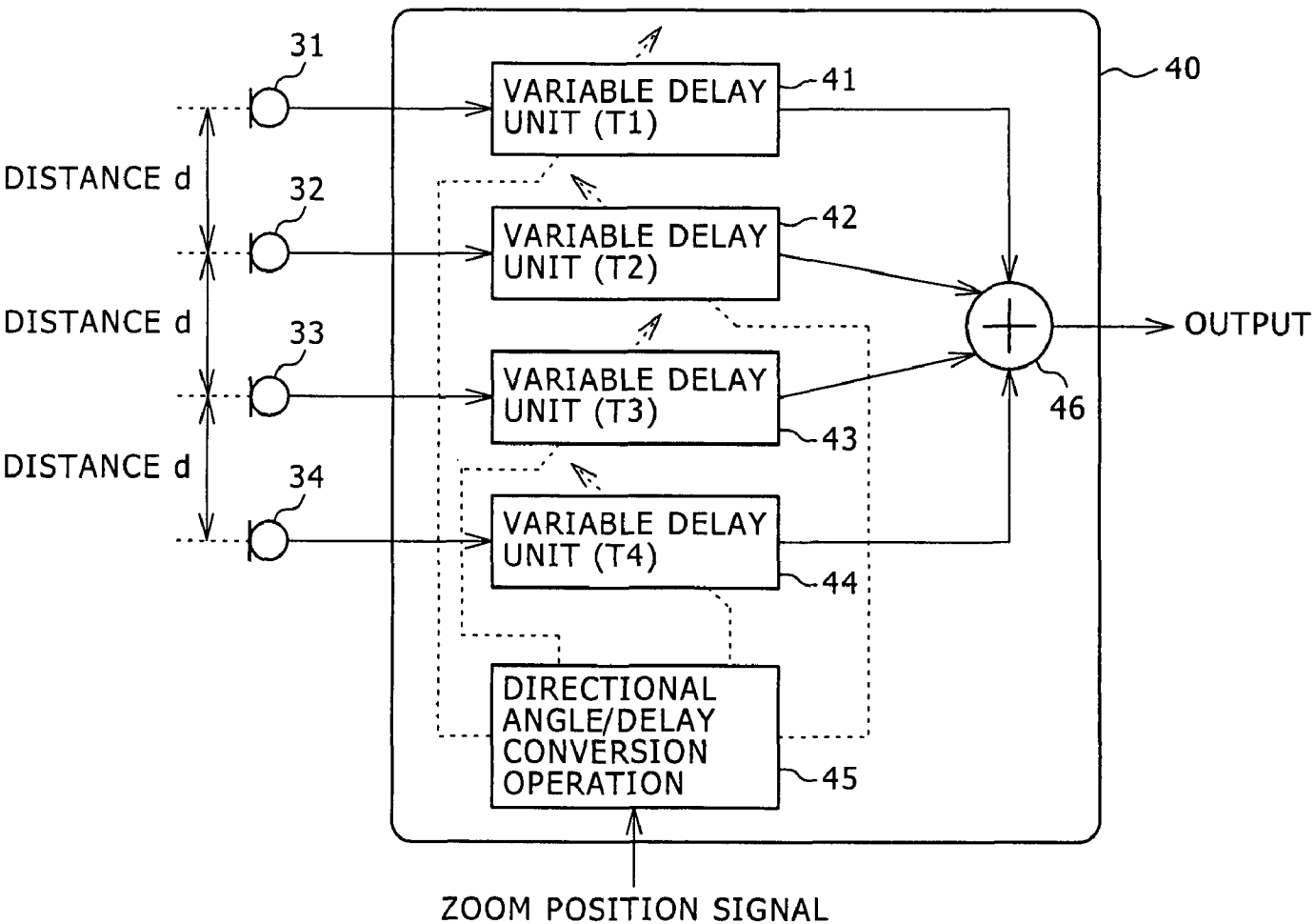
FIG. 8 is a view for explaining a processing example of generating the microphone directivity according to the present invention.

FIG. 8 shows an example of microphone directivity generation. The microphones 31 to 34 are those corresponding to the array microphone contained in each of the microphones 17 and 18 in the horizontal and the vertical directions shown in FIG. 2, and a directivity generation processing circuit 40 corresponds to the microphone directivity generating processor 19.

The directivity generation processing circuit 40 has variable delay units 41, 42, 43, and 44, a directional angle/delay conversion operating unit 45, and an adder 46. Each of the microphones 31 to 34 is linearly arranged at the distance d, respectively. Outputs from the microphones 31 to 34 are supplied to the variable delay units 41 to 44, respectively. After a delay processing, as described later, is given to output signals of the microphones 31 to 34 in the variable delay units 41 to 44, the output signals are all added and outputted in the adder 46.

The variable delay units 41 to 44 are configured such that a delay amount of each of the variable delay units is set independently with the directional angle/delay conversion operating unit 45. The directional angle/delay conversion operating unit 45 performs, upon a reception of the zoom position signal from the zoom lens 10, a conversion from a directional angle signal calculated on the basis of the given zoom position signal into the delay amount that is the most suitable to each of the variable delay units 41 to 44. It is noted that when the directional angle is fixed in the prescribed position without being set to be variable with a zooming operation, the directional angle/delay conversion operating unit 45 is supposed to fix the delay amounts of the variable delay units 41 to 44 to a prescribed value.

The directional angle/delay conversion operating unit 45 is now described in detail with reference to FIGS. 9 and 10.

An angle in a front direction of the microphone is specified as 0° in a plane including all the linearly arranged microphones 31 to 34. FIG. 9 shows a case where the directional angle is generated in an arbitrary directional angle θ direction at the microphone 31-side. The directional angle θ is assumed to be variable from 0° to 90° at maximum. Likewise, FIG. 10 shows a case where the directional angle is generated in an arbitrary directional angle −θ direction at the microphone 34-side, in which case, the directional angle −θ is assumed to be variable from 0° to −90° at maximum.

Figure 9:
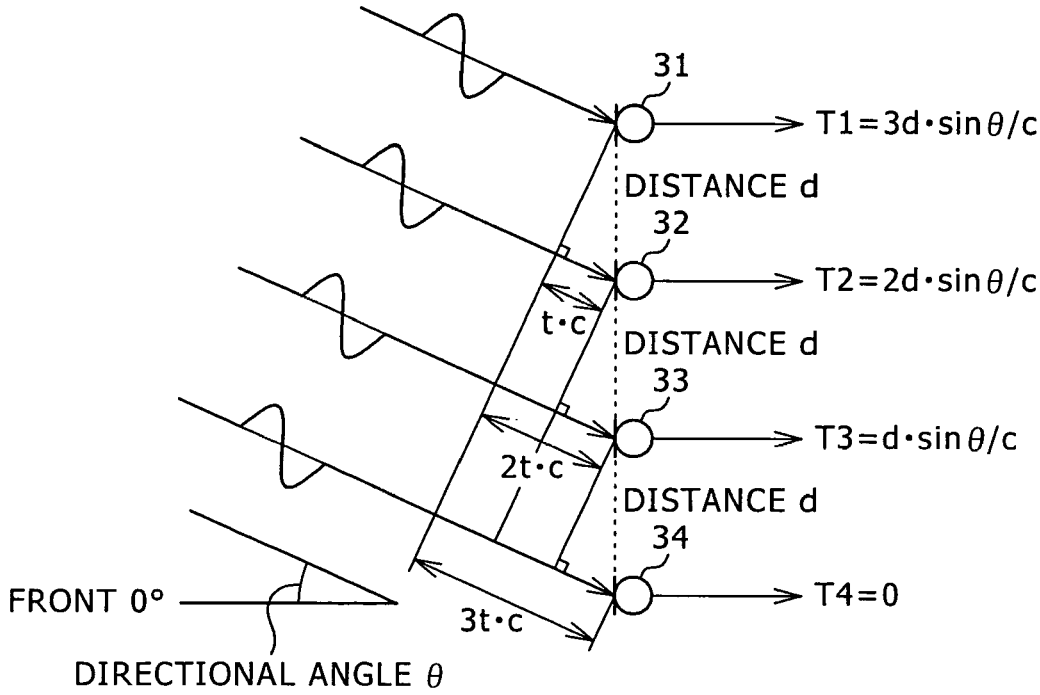
FIG. 9 is a view for explaining a principle of microphone directional angle/delay conversion according to the present invention.

In FIG. 9, given that relative distance differences in the microphone 32 from the microphone 31, in the microphone 33 from the microphone 31, and in the microphone 34 from the microphone 31 are now respectively tc, 2tc, and 3tc, delay amounts T1 to T4 supposed to be respectively set by the variable delay units 41 to 44 placed at a post-stage of the microphones 31 to 34 are given as follows, provided that d represents a distance between microphones (inter-microphone distance) and c represents the sound velocity:

$$T1=(3d\cdot\sin\theta)/c$$

$$T2=(2d\cdot\sin\theta)/c$$

$$T3=(d\cdot\sin\theta)/c$$

$$T4=0$$

Figure 10:
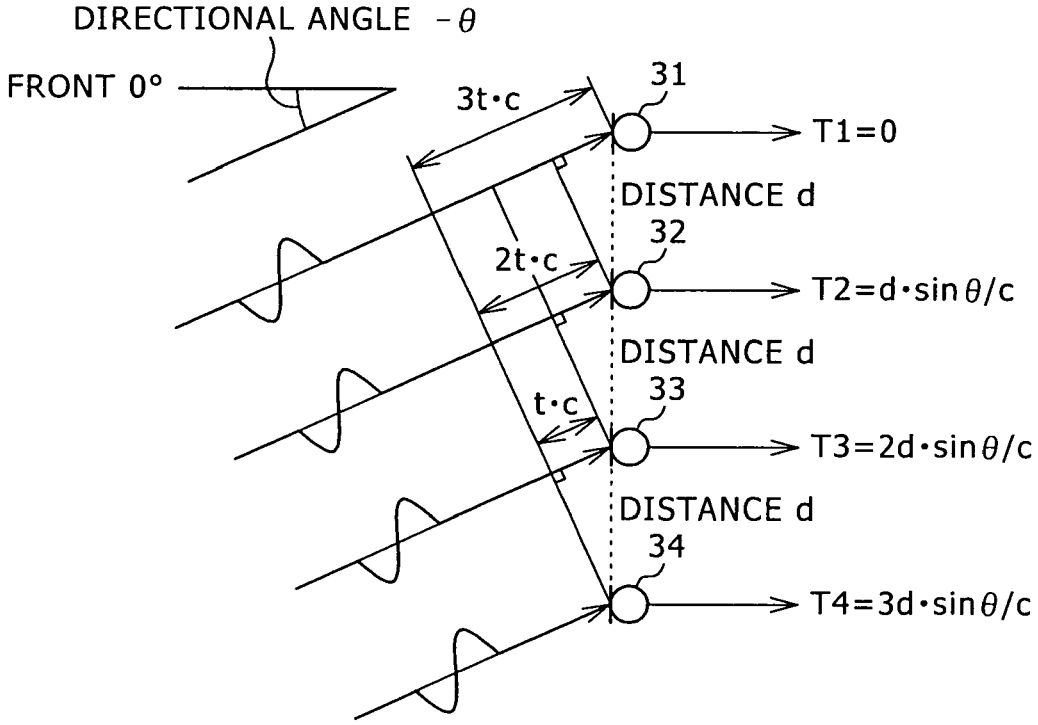
FIG. 10 is a view for explaining the principle of microphone directional angle/delay conversion according to the present invention.

Likewise, in FIG. 10, given that the relative distance differences in the microphone 31 from the microphone 34, in the microphone 32 from the microphone 34, and in the microphone 33 from the microphone 34 are respectively 3tc, 2tc, and tc, the delay amounts T1 to T4 supposed to be respectively set by the variable delay units 41 to 44 placed at the post-stage of the microphones 31 to 34 are given as follows:

$$T1=0$$

$$T2=(d\cdot\sin\theta)/c$$

$$T3=(2d\cdot\sin\theta)/c$$

$$T4=(3d\cdot\sin\theta)/c$$

For instance, if the inter-microphone distance d is assumed to be 10 mm at room temperature, the delay amounts T1 to T4 supposed to be set as typical directional angles θ (90°, 60°, 30°, 0°, −30°, −60°, −90°) are given as shown in FIG. 11.

Thus, in the array microphone configured as described above, if the delay amounts are set as described above, it is possible to obtain directivity for the arbitrary directional angle θ. If two sets of directivity generation processing circuits 40 of FIG. 8 are connected to a set of array microphones at a time and a delay amount is set so as to give a prescribed directional angle to each of the microphones, directivity is generated in a line direction of the array microphone. Furthermore, if the array microphone is used in each of the horizontal and vertical directions, directivity is generated in each of the horizontal and vertical directions, resulting in attaining the purpose of the present invention. It is noted that the number of microphones, the inter-microphone distance, and the microphone arrangement that have been described in the embodiment of the present invention are illustrative and not restrictive, and it is to be understood that changes may be made properly without departing from the purpose of the present invention.

Figure 12:
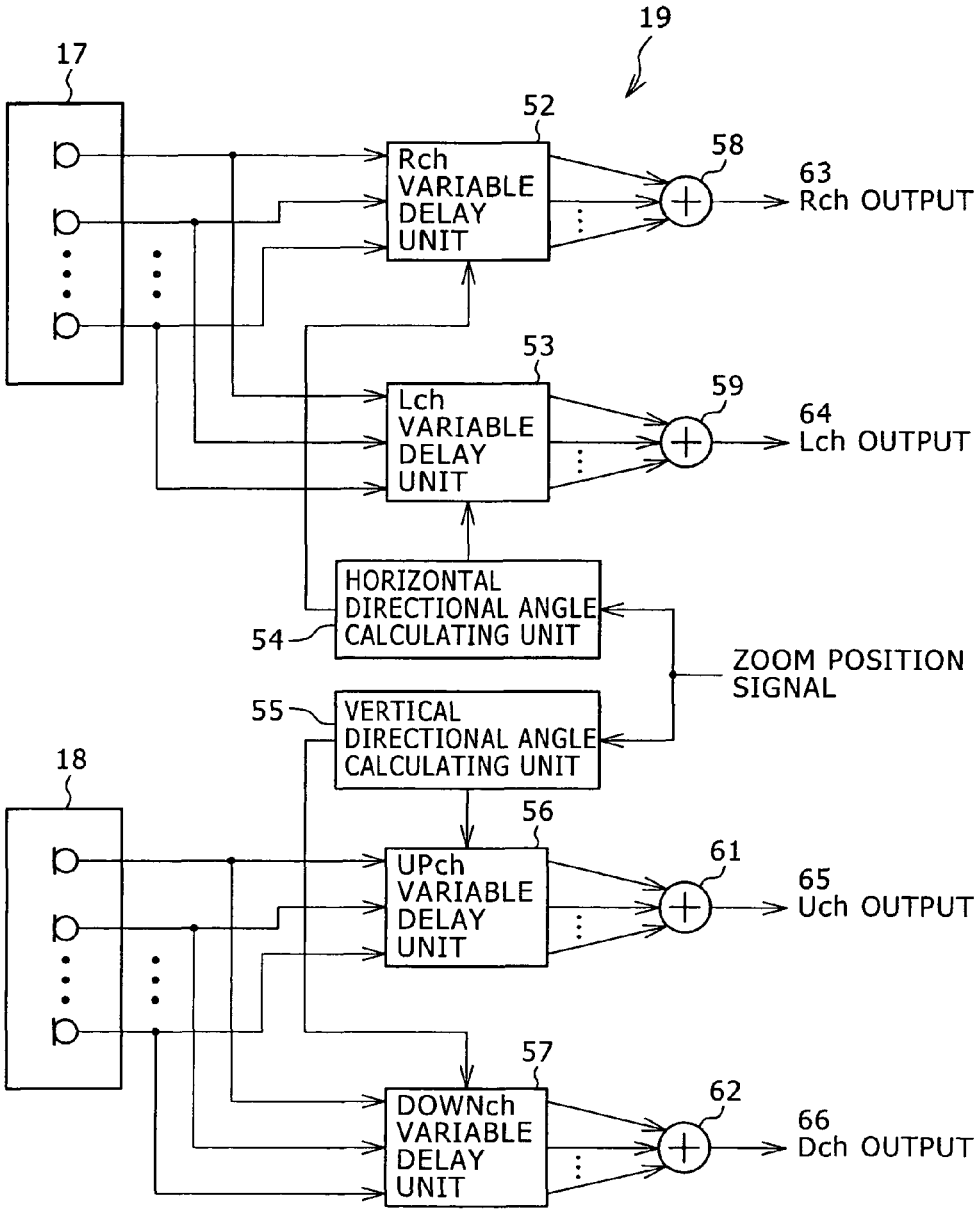
FIG. 12 is a view for explaining a processing example of generating the microphone directivity according to the present invention.

A configuration example of the microphone directivity generating processor 19 having been described with reference to FIG. 2 is now described in combination with a processing example of generating microphone directivity shown in FIG. 12.

The array microphone 17 is composed of a plurality of microphones horizontally arranged in the form of an array, and output signals from the microphones are respectively inputted to a R-channel variable delay unit 52 and a L-channel variable delay unit 53, and they are then given the delay amounts by a horizontal directional angle calculating unit 54 so as to provide a directional angle matched to a captured image view angle. The horizontal directional angle calculating unit 54 ensures that the directional angle matched to the zooming depending on the zoom position signal from the zoom lens 10 can be varied. Then, the signals respectively having been given the delay processing are added in adders 58 and 59, and they are then outputted as a R-channel output 63 and a L-channel output 64.

Likewise, the array microphone 18 is composed of a plurality of microphones vertically arranged in the form of the array, and the output signals from the microphones are respectively inputted to an U-channel variable delay unit 56 and a D-channel variable delay unit 57, and they are then given the delay amounts by a vertical directional angle calculating unit 55 so as to provide the directional angle matched to the captured image view angle. The vertical directional angle calculating unit 55 ensures that the directional angle matched to the zooming depending on the zoom position signal from the zoom lens 10 can be varied. Then, the signals respectively having been given the delay processing are added in adders 61 and 62, and they are then outputted as an U-channel output 65 and a D-channel output 66.

The R-channel, the L-channel, the U-channel, and the D-channel outputs 63 to 66 generated as described above result in left-and-right and up-and-down sound signals, relating to a video signal, that have been picked up from each of the directivity directions B, A, C and D shown in FIG. 4. Thus, a left-and-right and up-and-down sound reproduction relating to the video displayed on the display 1 may be realized by reproducing the above outputs through the respective speakers 3, 2, 4, and 5 of the sound reproducing apparatus 100 shown in FIG. 2 (and FIG. 1A) independently.

Further, in the embodiment of the present invention, the array microphones 17 and 18 are adopted as the horizontal and vertical sound generating means, so that the use of the array microphones in combination with the microphone directivity generating processor 19 ensures that an optimum directivity may be easily generated by selecting the directivity direction depending on the delay amount, and also that the directivity characteristic may be optimized depending on the number of microphones, thereby enabling the directivity to be changed relatively freely.

In the foregoing, while the embodiment of the present invention has been described, it is to be understood that the present invention is of course not limited to the above embodiment, and various modifications may be made on the basis of a technical concept of the present invention.

For instance, while the above embodiment of the present invention is adapted to reproduce the horizontal and vertical sound fields related to the video signal using the speakers 2 to 5 (or 6 to 9) arranged to surround the display 1 or the vicinity thereof, it is also allowable to apply, in addition to the above, an omni-directional surround system to the present invention.

Figure 13A:
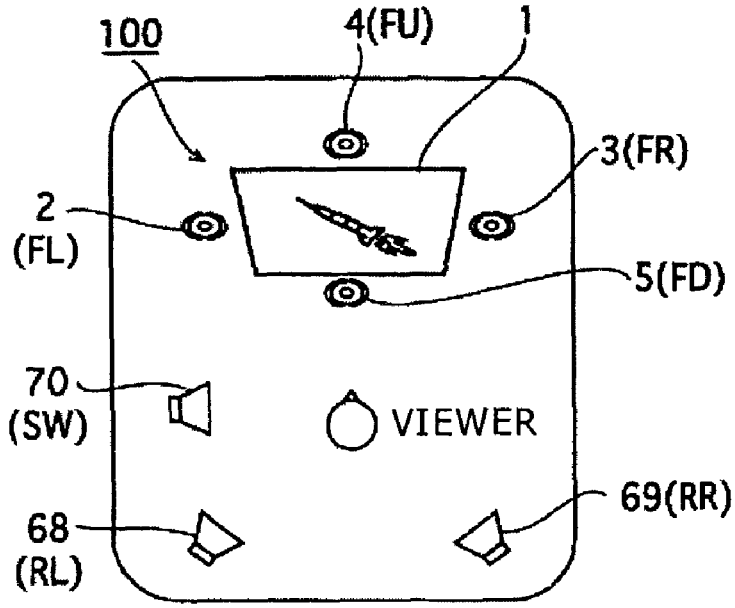
FIG. 13, consisting of FIG. 13A and FIG. 13B, is a schematic view of the configuration of the sound reproducing apparatus for explaining a different embodiment of the present invention.

For instance, a stereoscopic sound field reproduction system in FIG. 13A shows an example in which a Rear-Left-channel (RL) speaker 68 and a Rear-Right-channel (RR) speaker 69 are arranged at the rear of a viewer, with a Sub Woofer (SW) speaker 70 arranged as a woofer at a desired position, in addition to the sound reproducing apparatus 100 (See FIG. 1A) in which the Front-Left-channel (FL) speaker 2 and the Front-Right-channel (FR) speaker 3 in the left and the right directions, and the Front-Up-channel (FU) speaker 4 and the Front-Down-channel (FD) speaker 5 in the up and the down directions are arranged around the display 1 ahead of the viewer.

Figure 13B:
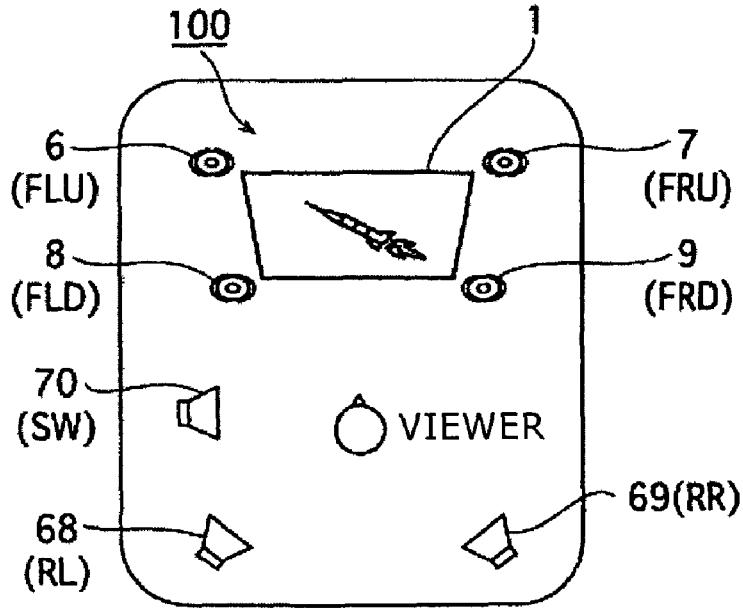

Further, FIG. 13B shows a different embodiment of the stereoscopic sound field reproduction system in which the RL and the RR speakers 68 and 69 are arranged at the rear of the viewer, with the SW speaker 70 arranged as the woofer at the desired position, in addition to the sound reproducing apparatus 100 (See FIG. 1B) in which the Front-Left-Up-channel (FLU) speaker 6, the Front-Right-Up-channel (FRU) speaker 7, the Front-Left-Down-channel (FLD) speaker 8 and the Front-Right-Down-channel (FRD) speaker 9 are arranged around the display 1 ahead of the viewer.

The use of the above stereoscopic sound reproduction system enables the sound signals supporting a surround sound system, such as the 5.1-channel surround system, to be easily obtained, in which case, the combination of the surround sound field with the sound field matched to the direction of the object on the display according the present invention may provide the richer feeling of presence for the viewer. It is noted that, in a case of picking up a multi-channel signal as described above with the microphones mounted in the video camera, etc., a directional microphone may be directed to each directivity direction to pick up the multi-channel signal, or alternatively, the array microphone may be combined with a surround microphone. Furthermore, an available audio format serving to record the multi-channel signal given from each direction includes a MPEG2/AAC (Advanced Audio Coding) method, etc. supposed to support up to a 7.1 channel.

While the above embodiment of the present invention has been described is the embodiments respectively including the four speakers 2 to 5 or 6 to 9 arranged around the display 1 (See FIGS. 1A and 1B) as the sound reproducing apparatus 100, it is to be understood that the number of speakers installed or the microphone mounting positions, etc. are not limited to the above embodiments.

Figure 14:
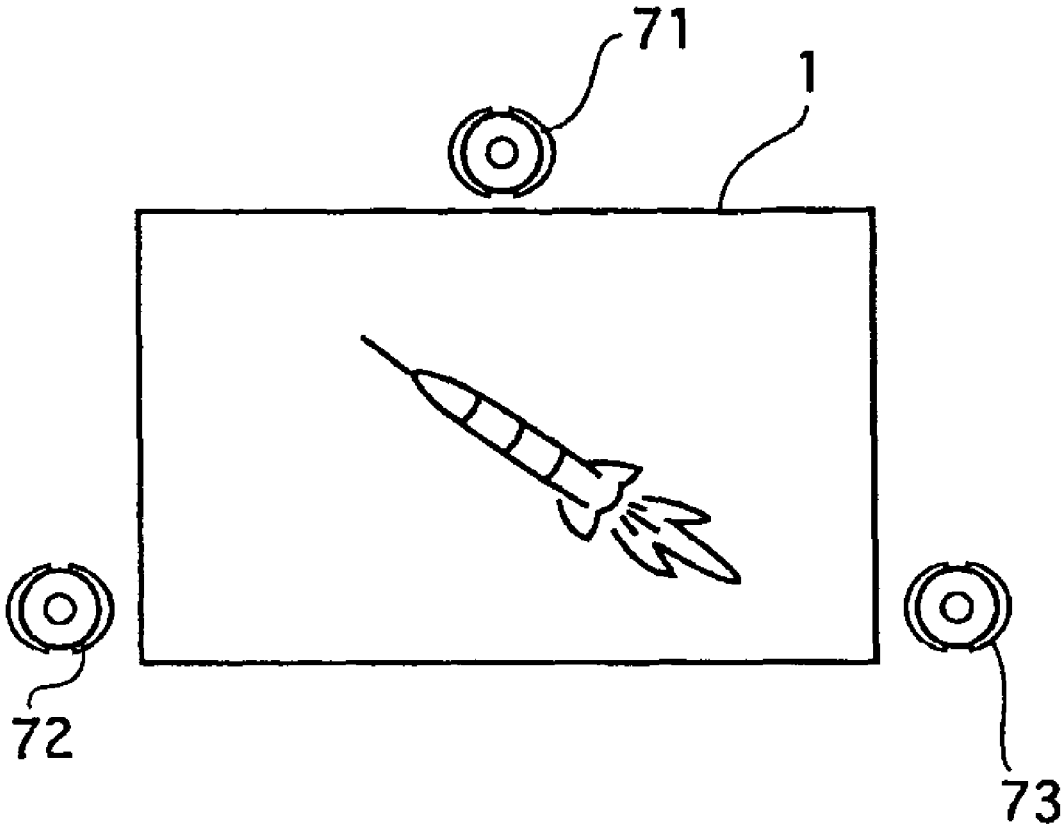
FIG. 14 is a schematic view of a configuration of a sound reproducing apparatus for explaining a further different embodiment of the present invention.

For instance, FIG. 14 shows a different embodiment of the sound reproducing apparatus including three speakers 71, 72 and 73 that are mounted around the display 1. In this embodiment, the speakers 71 to 73 are installed one-by-one at an approximately center portion of the upper edge, and lower portions of the left and the right edges, in which case, all the speakers 71 to 73 are adapted to reproduce the up-and-down sound field, while the speakers 72 and 73 are adapted to reproduce the left-and-right sound field. This embodiment also enables the same effects as described above to be obtained.

Meanwhile, as further different embodiments of the present invention, these multi-channel sound field generating functions may be incorporated into the video camera to embody the present invention at real time in the recording and reproduction, or, alternatively, the video and the multi-channel audio are individually recorded to embody the present invention as an application software contained in a computer, and as a non real-time processing at an audio-video file editing time, or a file translation time, or a DVD writing time.

Further, the present invention is also applicable to a purpose of games. In this case, the same sound effects as the above also may be obtained by generating the sound signal in each direction around the display to match a sound source position on a computer graphics (CG) display.

In recent years, a technology also has been developed in which a transparent diaphragm is mounted to a front face of the display, for instance, to reproduce the sound field by vibrating the diaphragm with the sound signal without using any speaker around the display. The present invention also may be embodied by taking advantage of a sound output means described above.

The present document contains subject matter related to Japanese Patent Application JP 2004-248249 filed in the Japanese Patent Office on Aug. 27, 2004, the entire contents of which are incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A sound generating method of generating sound signals related to a video signal, comprising:

generating independently by horizontal and vertical generating means each of a horizontal signal and a vertical signal of the sound signals matched respectively to a horizontal direction and a vertical direction of a video;

varying a directivity characteristic of each of said horizontal and vertical generating means, in a manner that an up-and-down motion of a sound image of the video matches the directivity characteristic of each of said horizontal and vertical generating means; and reproducing independently the horizontal and the vertical sound signals that have been generated with horizontal sound output means and vertical sound output means, respectively, in a manner that an up-and-down motion of a sound image is represented.

2. The sound generating method according to claim 1, wherein the sound signals matched to said horizontal direction and said vertical direction are generated using an array microphone provided with a directivity characteristic.

3. The sound generating method according to claim 2, wherein the directivity characteristic of said array microphone is varied to match an image size of the video.

4. A sound generating apparatus for generating sound signals related to a video signal, comprising:

horizontal sound generating means for independently generating a sound signal matched to a horizontal direction of a video;

vertical sound generating means for independently generating a sound signal matched to a vertical direction of the video; and directivity generating means for varying a directivity characteristic of each of said horizontal and said vertical sound generating means, in a manner that an up-and-down motion of a sound image of the video matches the directivity characteristic of each of said horizontal and said vertical sound generating means.

5. The sound generating apparatus according to claim 4, further comprising:

image capturing means for capturing an object image; and recording/reproducing means for recording and reproducing the video signal generated by said image capturing means and the sound signals generated by said horizontal and said vertical sound generating means.

6. The sound generating apparatus according to claim 4, wherein:

said horizontal sound generating means and/or said vertical sound generating means is an array microphone composed of a plurality of linearly arranged microphones.

7. The sound generating apparatus according to claim 4, wherein:

said directivity generating means varies a directional angle of each of said horizontal and said vertical sound generating means on the basis of optical view angle information given from said image capturing means.

8. A sound reproducing method of reproducing sound signals related to a video signal, comprising:

reproducing independently, with horizontal sound output means and vertical sound output means that are arranged to surround the vicinity of a display serving to display a video, a horizontal sound signal and a vertical sound signal having been independently generated respectively by horizontal and vertical generating means, whose a directivity characteristic was varied in a manner that an up-and-down motion of a sound image of the video signal matches the directivity characteristic of each of said horizontal and vertical generating means, to match a horizontal direction and a vertical direction of the video, respectively, in a manner that an up-and-down motion of a sound image is represented.

9. A sound reproducing apparatus for reproducing sound signals related to a video signal, comprising:

a display screen serving to display a video; and horizontal sound output means and vertical sound output means that are arranged to surround the vicinity of said display, wherein a horizontal sound signal and a vertical sound signal that have been independently generated respectively by horizontal and vertical generating means, whose directivities characteristics are varied in a manner that an up-and-down motion of a sound image of the video matches the directivity characteristic of each of said horizontal and vertical generating means, to match a horizontal direction and a vertical direction of the video are reproduced independently with said horizontal and said vertical sound output means, respectively, in a manner that an up-and-down motion of a sound image is represented.

10. The sound reproducing apparatus according to claim 9, wherein said horizontal and said vertical sound output means are configured with at least three speakers arranged to surround the vicinity of said display.

11. The sound reproducing apparatus according to claim 10, wherein said horizontal and said vertical sound output means are configured with four speakers arranged at approximately center positions of left, right, upper, and lower edges of said display.

12. The sound reproducing apparatus according to claim 10, wherein said horizontal and said vertical sound output means are configured with four speakers arranged at four corner positions of said display.

13. A sound generating apparatus for generating sound signals related to a video signal, comprising:

a horizontal microphone for independently generating a sound signal matched to a horizontal direction of a video;

a vertical microphone for independently generating a sound signal matched to a vertical direction of the video; and a microphone directivity generating processor for varying a directivity characteristic of each of said horizontal and vertical microphones, in a manner that an up-and-down motion of a sound image of the video matches the directivity characteristic of each of said horizontal and vertical microphones.

14. A sound reproducing apparatus for reproducing sound signals related to a video signal, comprising:

a display screen serving to display a video; and horizontal speakers and vertical speakers that are arranged to surround the vicinity of said display; wherein:

a horizontal sound signal and a vertical sound signal having been independently generated respectively by horizontal and vertical microphones, whose a directivity characteristic was varied in a manner that an up-and-down motion of a sound image of the video signal matches the directivity characteristic of each of said horizontal and vertical microphones, to match a horizontal direction and a vertical direction of the video are reproduced independently with said horizontal and said vertical speakers, respectively, in a manner that an up-and-down motion of a sound image is represented.

15. An imaging apparatus for generating sound signals related to a video signal, comprising:

an image capturing element for capturing said video signal;

a microphone for system for independently generating a set of horizontal and vertical sound signals of said sound signals related to said video signal; and a microphone directivity generating processor for varying a directivity characteristic of said microphone system on the basis of zoom information given from said image capturing element, in a manner that an up-and-down motion of a sound image of said video signal matches the directivity characteristic of said microphone system, wherein the microphone system includes vertical and horizontal components respectively designated to generate said horizontal and vertical sound signals.

16. An imaging method for generating sound signals related to a video signal, the method comprising:

capturing said video signal using an image capturing element;

generating a sound signal corresponding to said video signal using a microphone system, where horizontal and vertical sound components of the sound signal are independently generated by horizontal and vertical components of the microphone system; and varying a directivity characteristic of said microphone system using a microphone directivity generating processor on the basis of zoom information given from said image capturing element, in a manner that an up-and-down motion of a sound image of said video signal matches the directivity characteristic of said microphone system.

* * * * *